US007428969B2

(12) United States Patent
Wu

(10) Patent No.: US 7,428,969 B2
(45) Date of Patent: Sep. 30, 2008

(54) ROTARY WRENCH DISPLAY BRACKET

(75) Inventor: Arthur Wu, Taichung Hsien (TW)

(73) Assignee: Proxene Tools Co., Ltd., Taichung (TW)

( * ) Notice: Subject to any disclaimer, the term of this patent is extended or adjusted under 35 U.S.C. 154(b) by 431 days.

(21) Appl. No.: 11/175,355

(22) Filed: Jul. 5, 2005

(65) Prior Publication Data

US 2007/0007154 A1 Jan. 11, 2007

(51) Int. Cl.
*A45C 11/26* (2006.01)

(52) U.S. Cl. ..... 206/349; 206/376

(58) Field of Classification Search ..... 206/349, 206/376, 377, 378, 495; 248/309.1; 211/70.6
See application file for complete search history.

(56) References Cited

U.S. PATENT DOCUMENTS 5,335,772 A * 8/1994 Chervenak et al. ..... 206/349
5,638,964 A * 6/1997 Ernst ..... 211/70.6
5,906,350 A * 5/1999 Kao ..... 248/688
5,996,817 A * 12/1999 Kao ..... 211/70.6
6,375,005 B1 * 4/2002 McCann ..... 206/349
6,401,923 B1 * 6/2002 Huang ..... 206/376
6,464,840 B1 * 10/2002 McCann ..... 206/349
6,837,373 B2 * 1/2005 Huang ..... 206/376
2002/0175257 A1 * 11/2002 Yen ..... 248/309.1
2006/0086636 A1 * 4/2006 Kuo ..... 206/495

* cited by examiner

*Primary Examiner*—David T. Fidei
(74) *Attorney, Agent, or Firm*—Banger Shia

(57) ABSTRACT

A rotary wrench display bracket comprises a retaining frame composed of a swing arm and a U-shaped retaining plate. A pivotal portion is extended from the retaining frame, whereby the retaining frame will rotate about the pivotal portion through the swing arm. The retaining frame further includes an inner U-shaped flexible plate for retaining a wrench going into the retaining frame. Thereby, the wrench can be secured on the display bracket and can swing smoothly about a connecting mount it is confined.

2 Claims, 9 Drawing Sheets

ROTARY WRENCH DISPLAY BRACKET

FIELD OF THE INVENTION

The present invention relates to wrench display brackets, more particularly to a rotary wrench display bracket especially for wrenches having a closed end or an open end.

BACKGROUND OF THE INVENTION

The wrench display bracket disclosed by U.S. Pat. No. 6,375,005 uses an arced groove formed at the lower end of the bracket for engaging a pin extended from the rear face of a swing arm. The bottom edge of an arch-shaped retaining plate is provided with an L-shaped block for engaging an L-shaped slot on the swing arm, forming a secured display configuration.

The above mentioned invention can house two types of wrenches and can allow smooth rotation of the wrenches. However, the invention has the following disadvantages.

The structure is too complicated. First, an arced groove must be formed on the hanging bracket, for receiving the pin form the swing arm. Second, each of the lateral sides of the swing arm has to be provided with an L-shaped slot, for engaging corresponding L-shaped blocks extended from the lower end of the bracket. Third, the retaining plate, together with the swing arm, is pivotally connected to the bracket by a pivot nut, a connecting unit and a locking ring.

The structure is adaptable to wrenches of few sizes. The receptacle defined by the retaining frame is set according to the width of the handle of a wrench, which cannot allow an insertion of wrenches of other sizes. Therefore, brackets of different sizes are needed to house a wide range of wrenches, leading to extra cost of making different molds for the brackets.

The display bracket disclosed by U.S. Pat. No. 6,874,630 is for displaying clippers and scissors but has an anti-theft unit. Being cut off a stopping piece of the unit, the arched flexible plates extended oppositely on two sides of the hollow center can support and retain a tool for either display or storage.

However, the anti-theft locking mechanism can used with clippers or scissors, and the tools disposed on the bracket cannot be swung. For buyers of wrenches, closed type or open type, testing the smoothness of rotation is important, which cannot be attained by the retaining effect of flexible plates alone.

SUMMARY OF THE INVENTION

The primary objective of the present invention is to provide a rotary wrench display bracket for retaining wrenches of open type and allowing a buyer to test the rotational smoothness of the wrenches attached on the wrench display bracket. Accordingly, the present invention utilizes a retaining frame composed of a swing arm and a U-shaped retaining plate. A pivotal portion is extended from the retaining frame, whereby the retaining frame will rotate about the pivotal portion through the swing arm. The retaining frame further includes an inner U-shaped flexible plate for retaining a wrench going into the retaining frame. Thereby, the wrench can be secured on the display bracket and can swung smoothly about a connecting mount it is confined.

The secondary objective of the present invention is to provide a rotary wrench display bracket wherein the depressed space defined by the retaining frame is equipped with flexible plates, whereby wrenches of different handle widths can be retained within the retaining frame for display.

To achieve above object, the present invention provides a rotary wrench display bracket. The bracket comprises a hanging slab being a slab body with a predetermined thickness, a through hole going through said hanging slab at a predetermined location; a retaining frame further comprising a swing arm and a retaining plate, a top end of said swing arm being provided with a pivotal through hole, a lower end of said swing arm being extended with a support plate, an end of said pivotal through hole being extended with a U-shaped retaining plate that can be freely opened, at least one lateral side of said retaining plate being provided with a flexible plate pointing inwardly; and a mount being a polygonal body passing through said pivotal hole and said through hole, said mount being capable of being rotationally secured with a connection portion on said hanging slab.

Furthermore, the present invention provides a rotary wrench display bracket. The bracket comprises a hanging slab being a slab body with a predetermined thickness, a through hole going through said hanging slab at a predetermined location; a retaining frame further comprising a swing arm and a retaining plate, a top end of said swing arm being provided with a pivotal through hole, a lower end of said swing arm being extended with a support plate having at least one depressed hole for engaging said U-shaped retaining plate, at least one lateral side of said retaining plate being provided with a flexible plate pointing inwardly; and a mount being a polygonal body passing said pivotal hole and said through hole, said mount being capable of being rotationally secured with a connection portion on said hanging slab.

The various objects and advantages of the present invention will be more readily understood from the following detailed description when read in conjunction with the appended drawings.

DETAILED DESCRIPTION OF THE PREFERRED EMBODIMENTS

Figure 1:
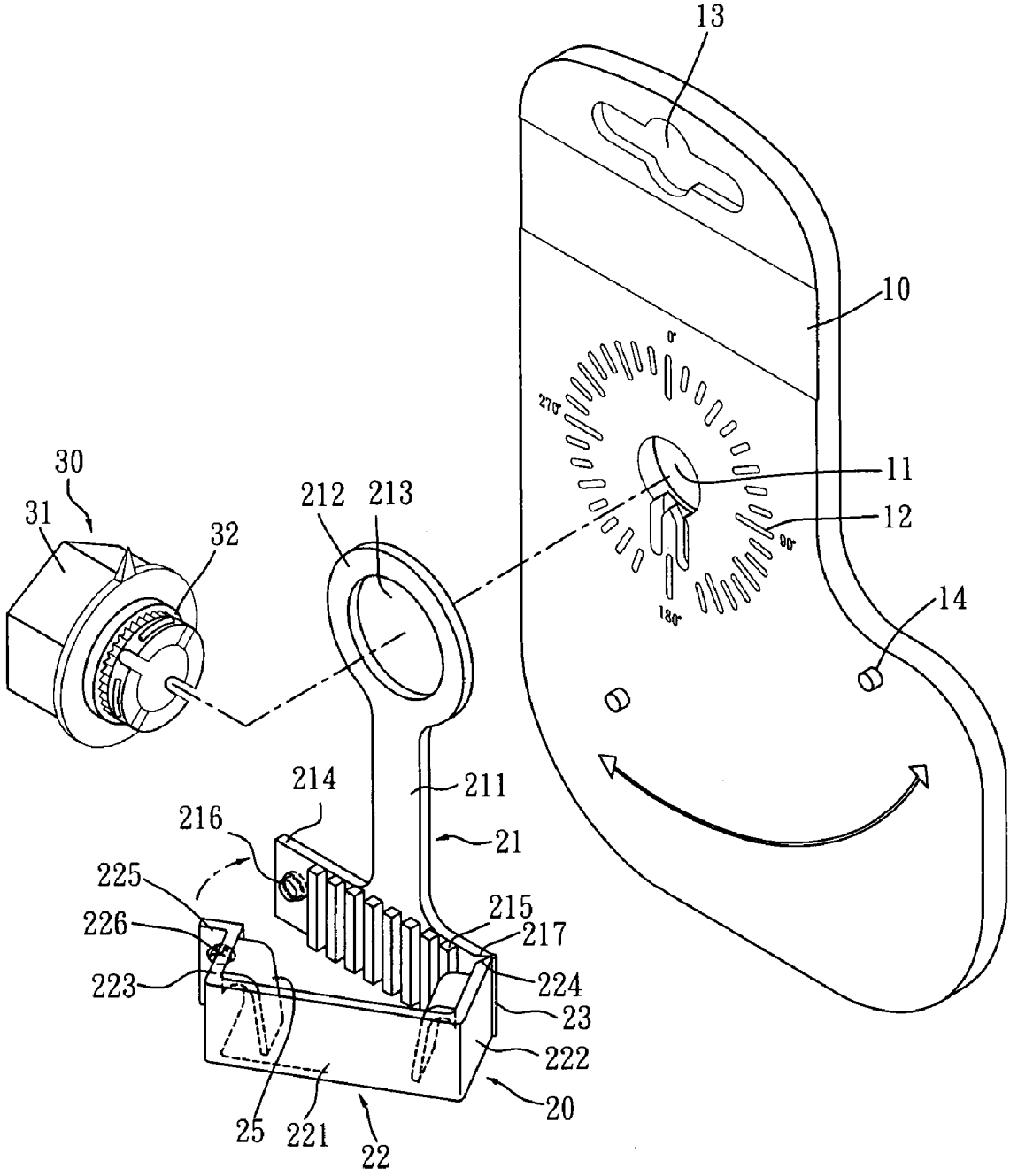
FIG. 1 is an exploded perspective view of a rotary wrench display bracket according to the present invention.
Figure 8:
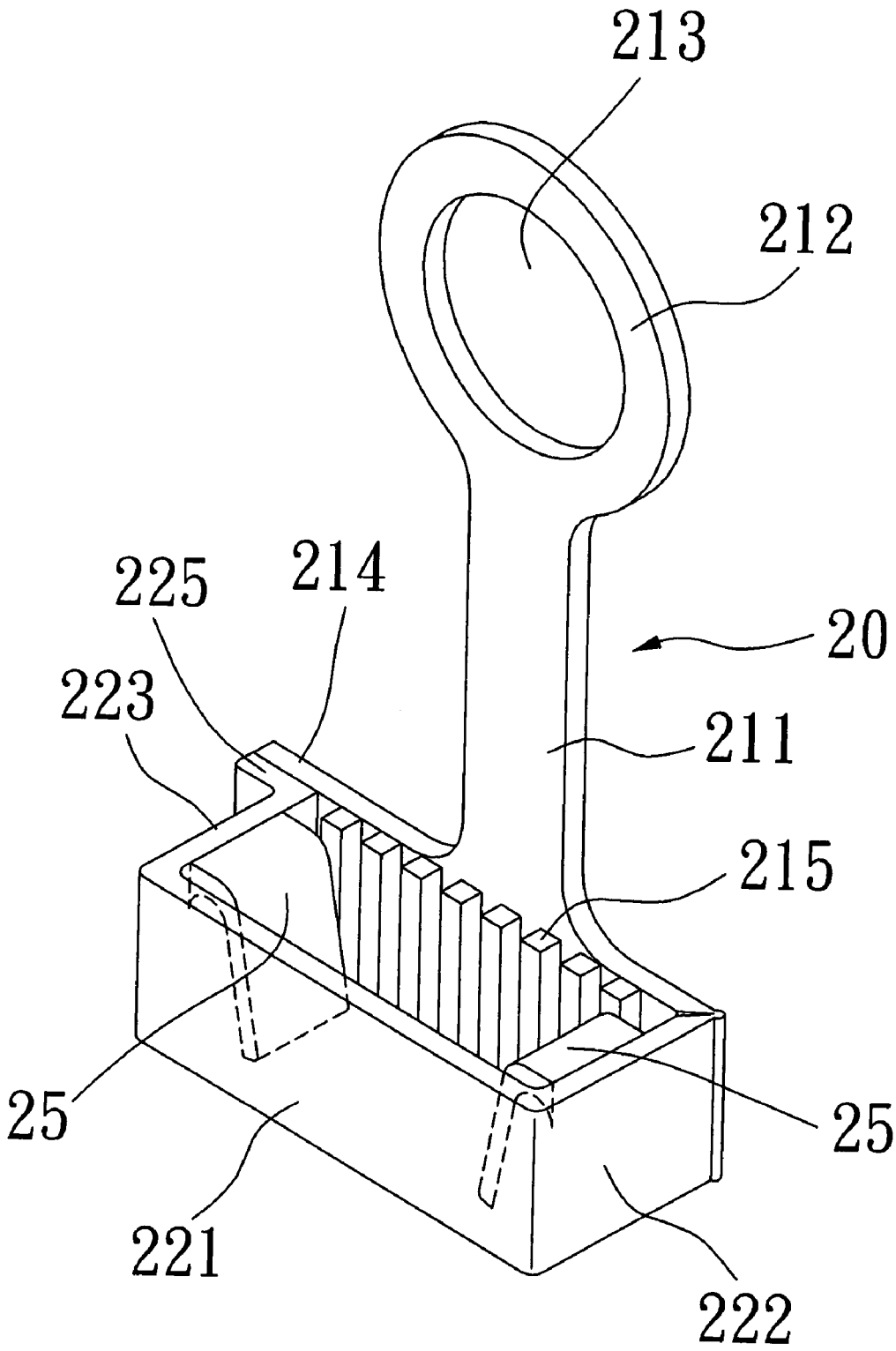
FIG. 8 is a perspective view of the rotary wrench display bracket in FIG. 3 wherein the swing arm and the retaining plate form the retaining frame.
Figure 10:
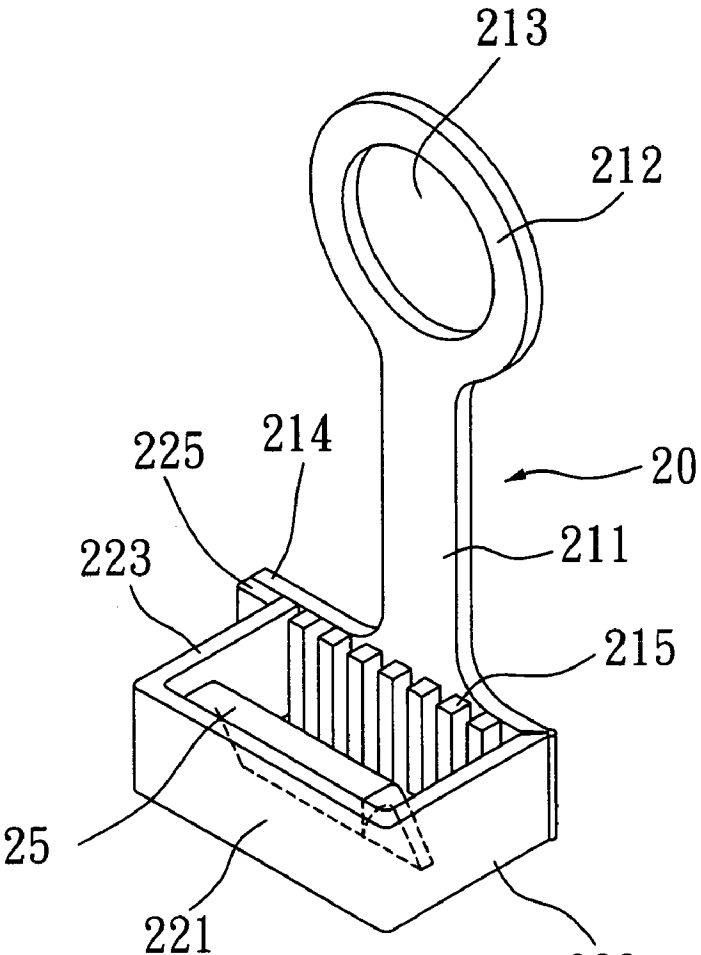
FIGS. 9 to 12 illustrate the rotary wrench display brackets in various preferred embodiments.

Referring to FIGS. 1 and 8, a rotary wrench display bracket comprises a hanging slab 10 being a vertically placed slab body with a predetermined thickness, a through hole 11 formed at a predetermined location on the hanging slab 10, a portion of calibrations 12 surrounding the through hole 11, a hanging hole 13 formed right above the through hole 11, a pair of confining projections 14 formed below the through hole 11 a predetermined distance apart on two opposite sides and a retaining frame 20 installed between the confining projections 14 capable of being swung therebetween.

The rotary wrench display bracket further includes a rotary wrench display bracket made of a plastic material or rubber consisting of a T-shaped swing arm 21 and a U-shaped retaining plate 22.

The swing arm 21 includes a middle neck section 211, whose top end is a round head section 212 with a diameter larger than the width of the middle neck section 211. The head section 212 has a pivotal hole 213 passed thereon, and the lower end of the middle neck section 211 is provided with a perpendicularly extending lower support plate 214. The surface of the lower support plate 214 extending toward two lateral sides of the lower support plate 214 is provided with a plurality of strips of plastic blocks 215, The two lateral sides of the support plate 214 are each a smooth plane, one of which planes is provided with a round depression 216 facing the retaining plate 22. The other smooth plane is provided with an obliquely cut surface 217 one an edge in the longitudinal direction thereon. The tip of obliquely cut surface 217 is extended outwardly with a rod-like pivotal portion 23, and the other end on the obliquely cut surface 217 is provided with the recessed retaining plate 22.

The recessed retaining plate 22 having a U-shaped cross section comprises a front plate 221, a first side plate 222 and a second side plate 223. Further, a blade 225 is extended outwardly from the second side plate 223. The blade 225 has an end face facing the round depression 216 and having a round projection 226 for engaging the round depression 216.

Moreover, the end of the first side plate 222 close to an end of the pivotal portion 23 is provided with an obliquely cut surface 224 which does not cut through the pivotal portion 23. Thereby, the swing arm 21 will rotate about the pivotal portion 23, and whereby the retaining plate 22 will be secured with the swing arm 21. Meanwhile, the obliquely cut surface 217 on the lower support plate 214 and the obliquely cut surface 224 on the first side plate 222 can make the engagement between the swing arm 21 and the retaining plate 22.

Thereby, the pivotal portion 23 is free to open and close. As the retaining frame is closed, the pivotal portion 23, the swing arm 21 and the retaining plate 22 are secured by the engagement between the round depression 216 on the surface of the pivotal portion 23 and the corresponding bulged piece 226 on the blade 225 extended outwardly from the second side plate 223 of the retaining plate 22, forming a closed retaining frame 20 for the insertion of a wrench.

To provide the retaining frame 20 with a better retaining function, at least one trumpet-like flexible plate 25 is installed on the inner wall thereof. As shown in FIGS. 1 to 8, the U shaped flexible plates 25 are integrally extended from the first side plate 222 and the second side plate 223 toward the internal space of the retaining frame 20. The flexible plates 25 adopt a varying width which is narrower at the lower ends and wider at the upper ends, and the width is generally narrower than the width of the handle of a wrench so that the wrench can be retained at a predetermined height.

Figure 6:
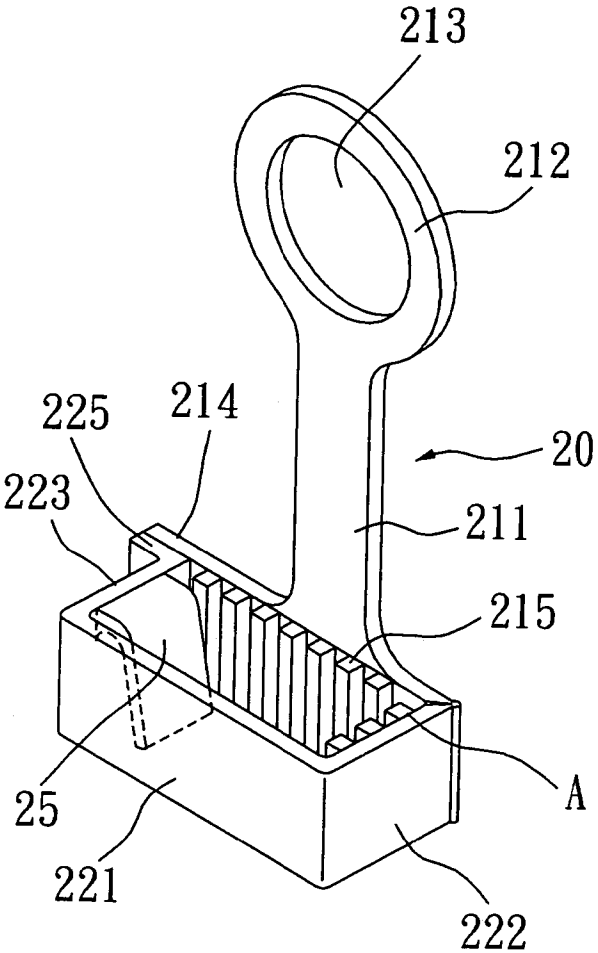
FIG. 6 is a perspective view of the rotary wrench display bracket in FIG. 3 wherein the flexible plate within the retaining frame is on a side.

In another preferred embodiment, a flexible plate 25 within the retaining frame 20 is extended from the second side plate 223 toward the internal depressed space. The first side plate 222 is instead provided with a plurality of plastic elongated support blocks A, as shown in FIG. 6.

Figure 7:
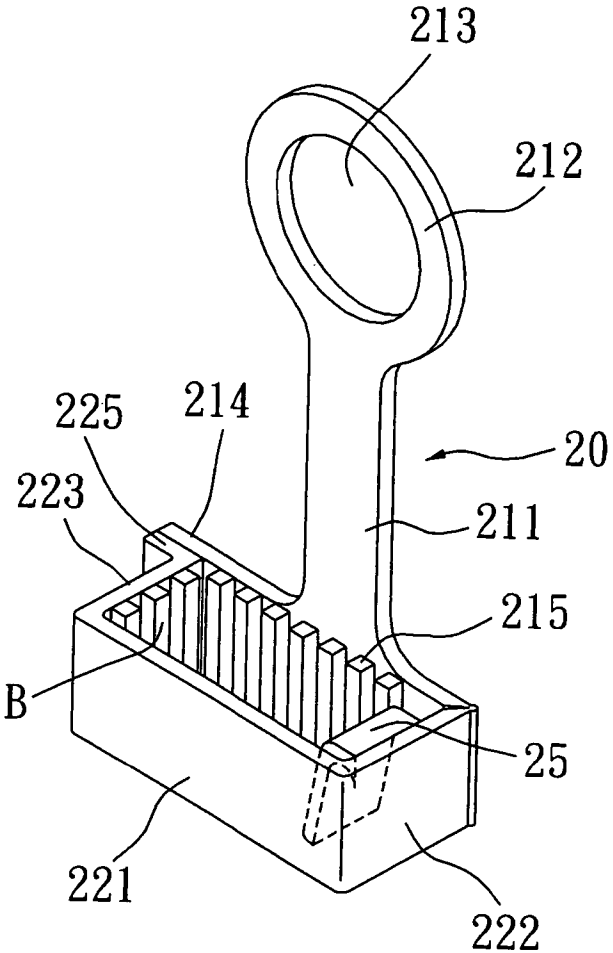
FIG. 7 is a perspective view of the rotary wrench display bracket in FIG. 3 wherein the flexible plate is on a side within the retaining frame is on another side.

As shown in FIG. 7, a flexible plate 25 within the retaining frame 20 is extended from the first side plate 222 toward the internal depressed space. The second side plate 223 is instead provided with a plurality of plastic elongated support blocks B, whereby a wrench can be retained at a proper height by sandwiched between the support blocks B and the flexible plate 25.

Figure 9:
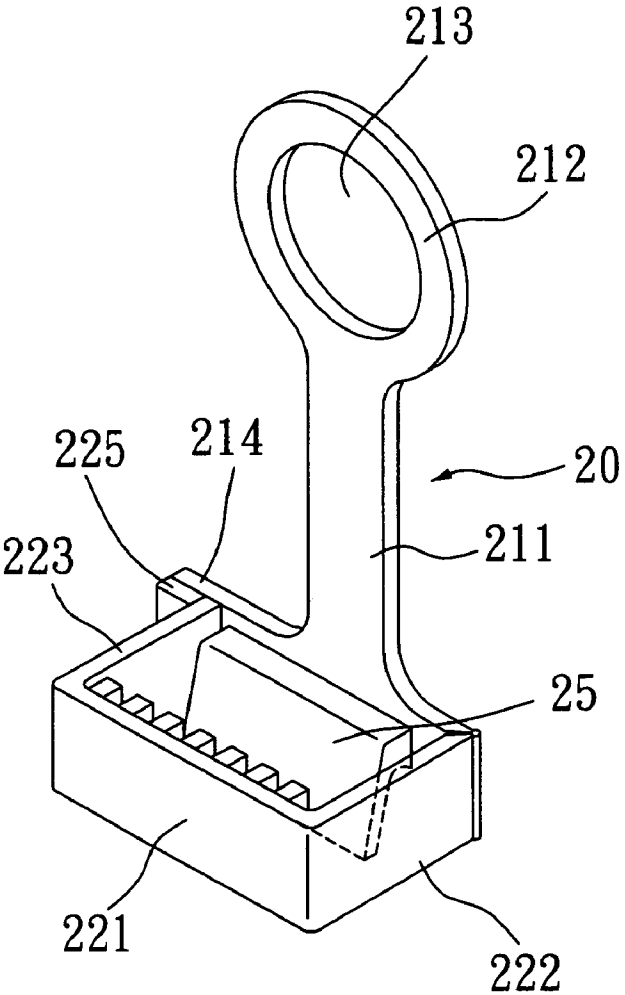

As shown in FIG. 9, the plastic block 215 of the lower support plate 214 can be formed like a flexible plate 25, and the front plate 221 of the retaining plate 22 can be formed like a plastic block 215. Thereby, the plastic block 215, the front plate 221 and the flexible plate 25 achieve a retaining effect on a wrench in the retaining frame.

Figure 12:
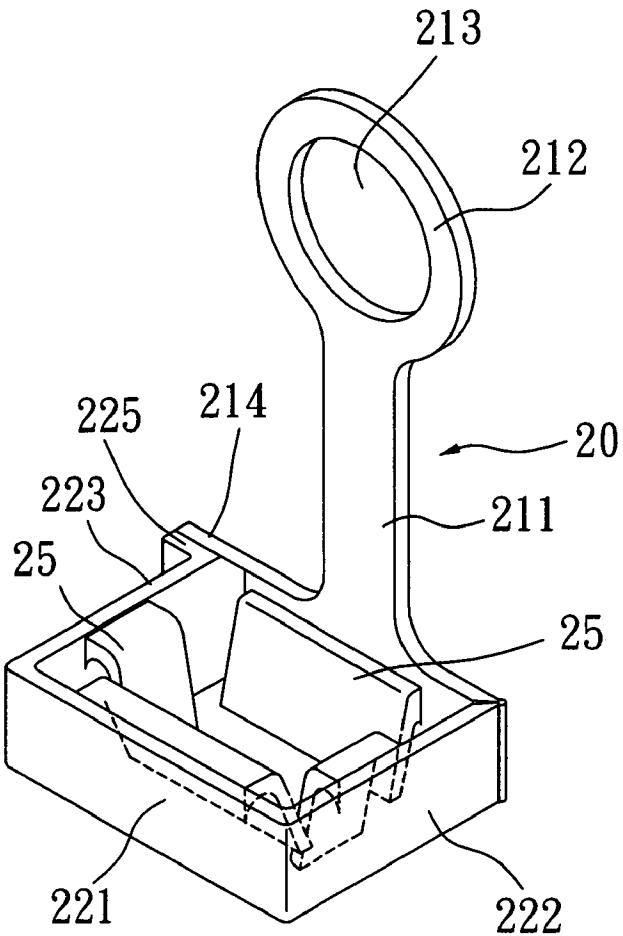
Figure 11:
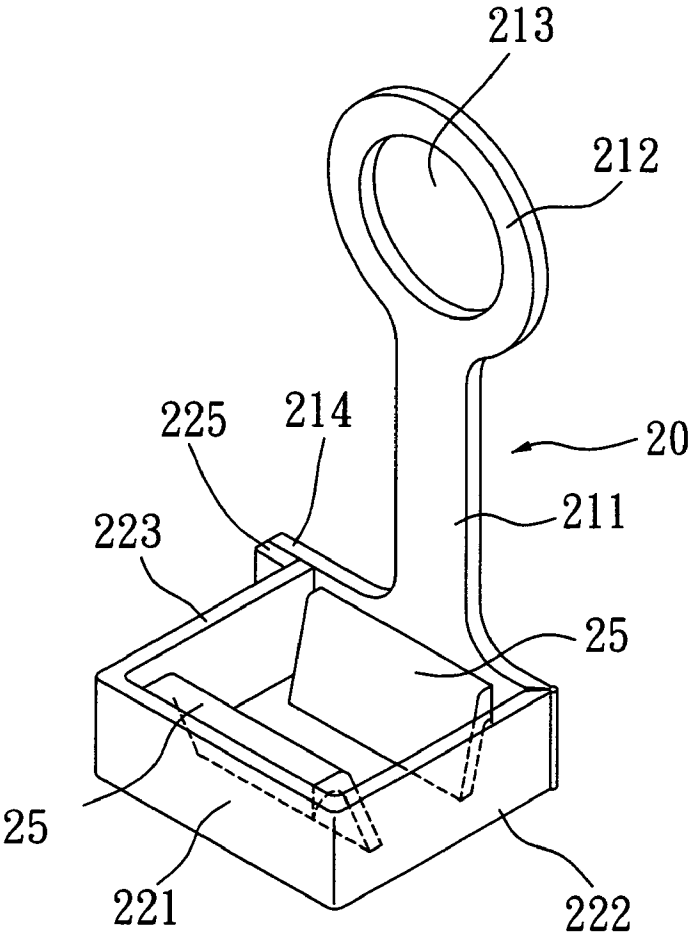

As shown in FIG. 11, flexible plates 25 within the retaining frame 20 are extended inwardly from the inner wall of the lower support plate and the inner wall of the front plate. As shown in FIG. 12, flexible plates 25 are respectively formed on four sides of the retaining frame 20, achieving a retaining effect on a wrench in the frame A connecting mount 30, being a polygonal object, comprises a hexagonal sleeve 31 for hanging a wrench and a column-like connecting part 32 bridging the hanging slab 10 and the retaining frame 20.

When the connecting part 32 of the connecting mount 30 is passing the pivotal hole 213 of the retaining frame 20 and the through hole 11 of the hanging slab 10, the projection at the end of the connecting part 32 and the hanging slab 10 are coupled to form a rotary mount.

Figure 2:
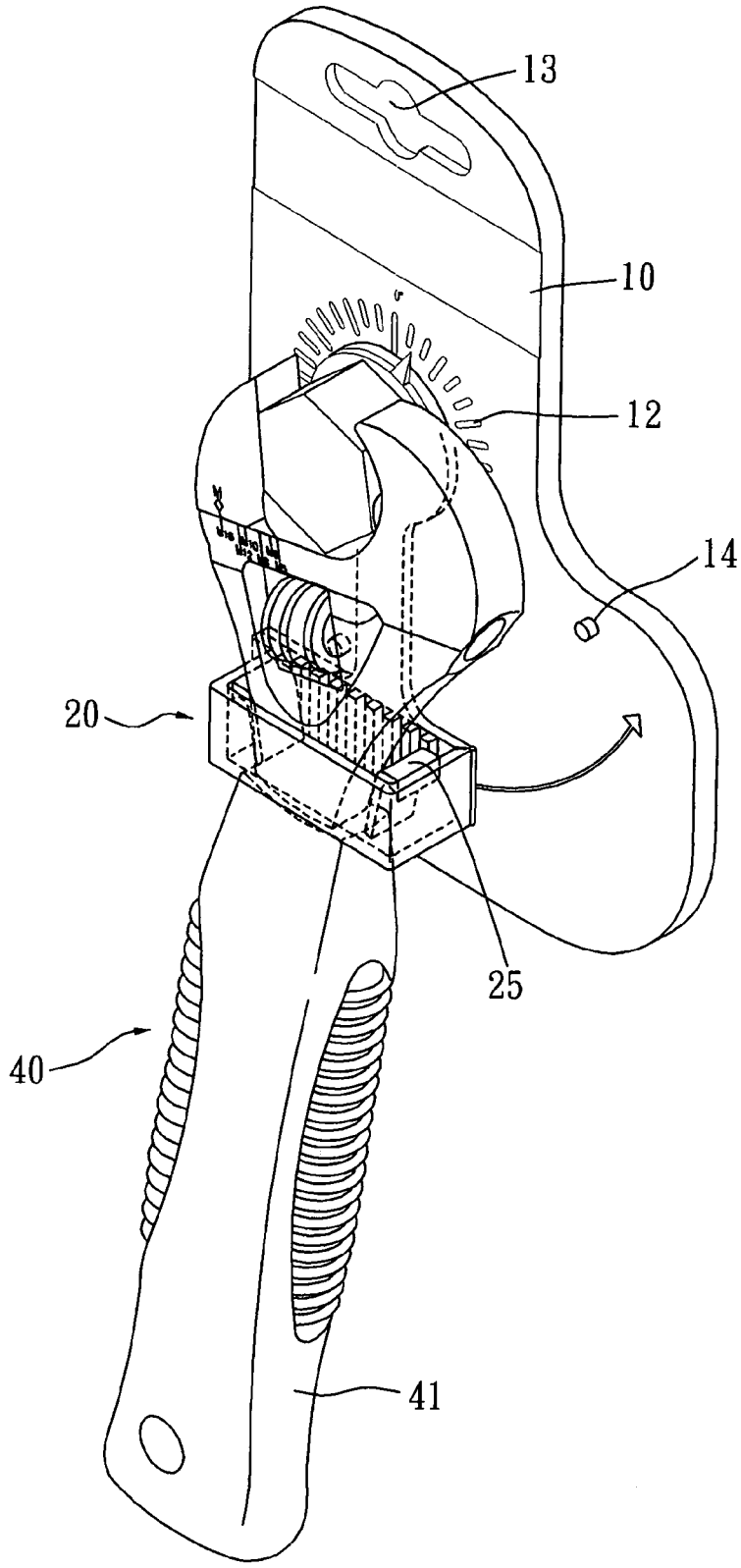
FIG. 2 is a perspective view of the rotary wrench display bracket in FIG. 1 used with a wrench.

Referring to FIG. 2, the assembly of the rotary wrench display bracket is realized by piercing the connecting part 32 of the connecting mount 30 through the pivotal hole 213 of the retaining frame 20, eventually into the through hole 11 of the hanging slab 10. Thereby, the retaining frame 20 will be pivotally connected with the hanging slab 10. The handle 41 of a wrench 40 is then inserted through the inner receptacle defined by the retaining frame 20, and the retaining plate 22 is pushed toward the swing arm 21. Meanwhile, the projection 226 on the retaining plate 22 is engaged with the round depression 216 on the swing arm 21. The assembly of the rotary wrench display bracket is therefore quick, and the assembled structure comprises only a hanging slab, a retaining frame and a connecting mount.

The three-component structure is so simple that the manufacturing, the materials used, the production management and the installation, is economized.

Figure 3:
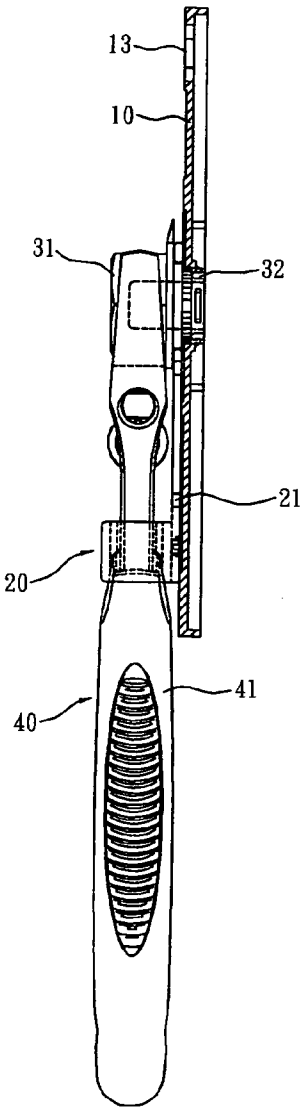
FIG. 3 is a side view of the rotary wrench display bracket in FIG. 1 used with a wrench.
Figure 4:
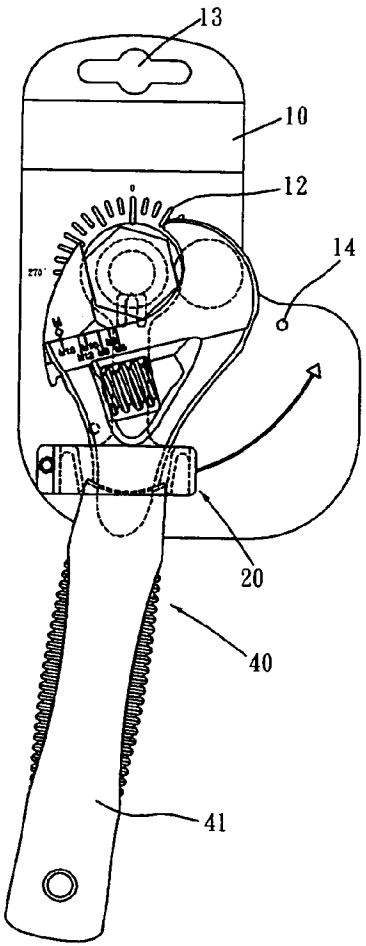
FIG. 4 is a front view of the rotary wrench display bracket in FIG. 3 wherein the wrench is swung to a side.
Figure 5:
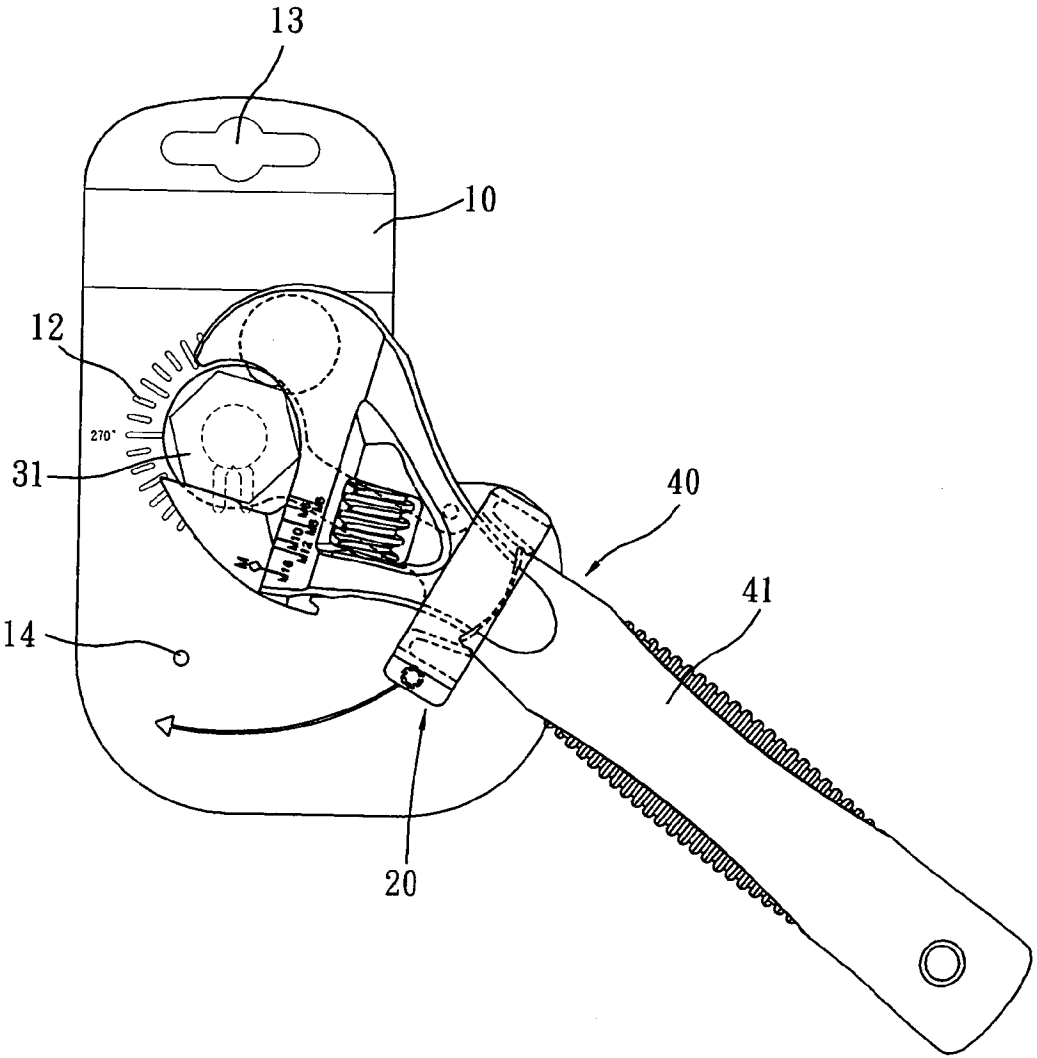
FIG. 5 is a front view of the rotary wrench display bracket in FIG. 3 wherein the wrench is swung to another side.

The primary objective of the rotary wrench display bracket is for displaying open-type wrenches, such as wrench with jaws, head-changeable wrenches, as shown in FIGS. 3, 4 and 5. In the figures, a depressed receptacle defined by the retaining frame 20 is equipped with flexible plates 25 on the opposite sides thereof. The flexible plates 25 further determine a flexible inner space with a width narrower than that of the handle 41 of the wrench 40, whereby the flexible plates 25 may hold the wrench 40 firmly when the wrench 40 is inserted within the retaining frame 20.

Besides the function of flexible retaining, the flexible plates 25 as indicated by FIGS. 1, 8 and 12 are extended from both of the first side plate 222 and the second side plate 223. The bracket of the present invention adopts the design of a pendulum clock. As the handle 41 of the wrench 40 is swinging left and right about the pivot, the handle 41 will be experiencing the restoring forces by the flexible plates 25, whereby the angular movement of the wrench will be confined and lessened, achieving a static and stable pinched configuration.

Referring to FIG. 3 the thickness of the plastic block 25 on the lower support plate 214 equals the minimal distance between the most bulged portion (mostly the head) and the slimmest portion (mostly the handle), the vibrations of the wrench 40 within the retaining frame 20 will be largely illuminated. Further, as the retaining plate 22 and the lower support plate 214 of the swing arm 21 are attached, the thickness of the plastic block 215 on the lower support plate 214 can be chosen slightly larger than the minimal distance between the most bulged portion (mostly the head) and the slimmest portion (mostly the handle) for confining the wrench to the flexible pinching between the lower support plate 214 and the front plate 221, as shown in FIG. 4

Referring to FIG. 5, a user only needs to hold the handle 41 as a rotational arm, whereby the retaining frame 20 will be rotated like the pendulum of a clock, whereby the smoothness of rotation of the wrench displayed will be tested.

As the wrench 40 is swung, the middle neck section 211 of the swing arm 21 will be stopped by the confining projections 14 on the hanging slab 10, whereby the rotational amplitude is properly restricted.

The retaining frame 20 of the present invention is extended with flexible plates 25 within its inner receptacle that is slightly narrower than that of the handle of a wrench for an effect of stable and flexible retaining of the wrench in the retaining frame 20. The flexile retaining mechanism can admits wrenches of different sizes.

Figure 13:
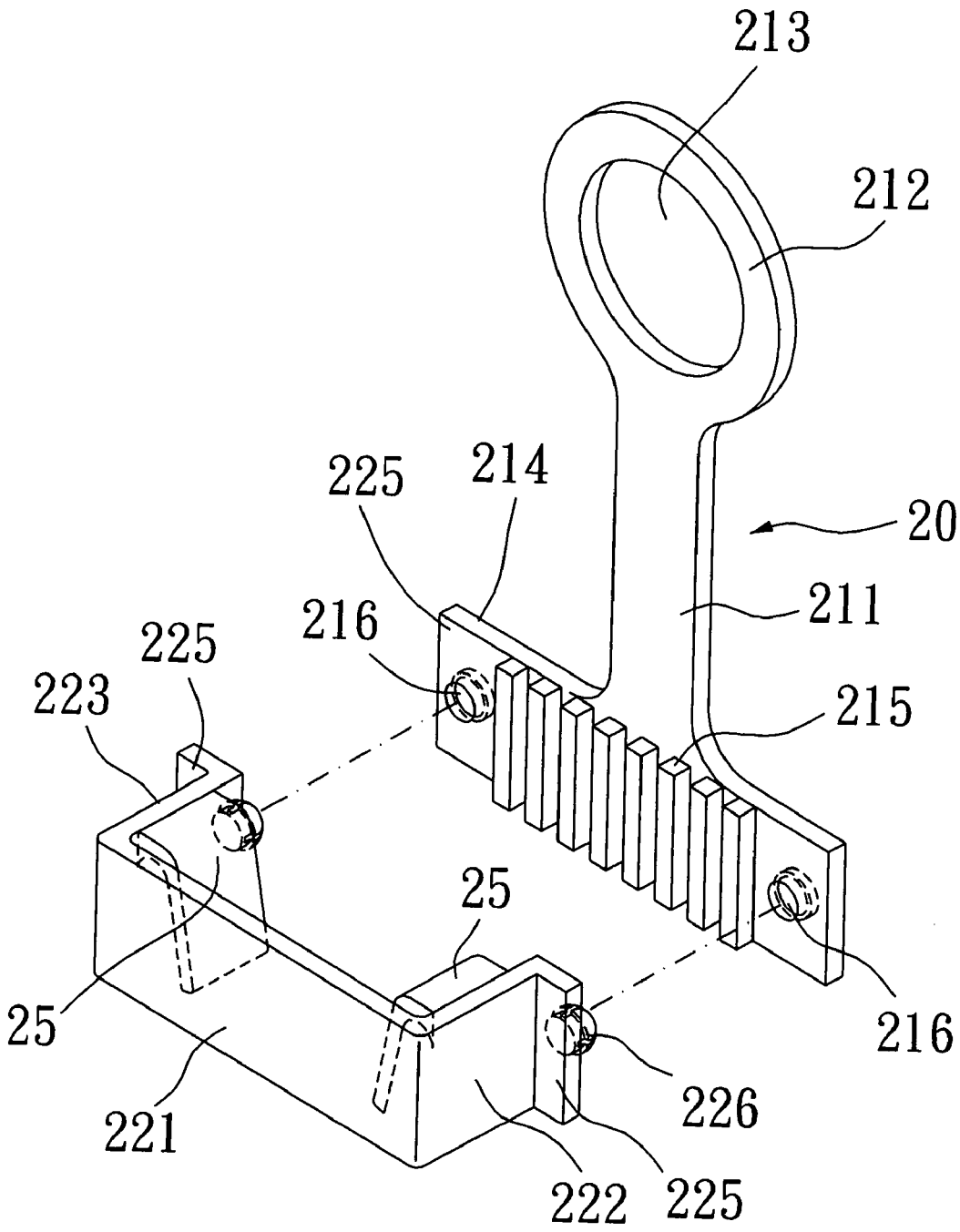
FIG. 13 is another preferred embodiment of a rotary wrench display bracket of this present invention.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims. For an example shown in FIG. 13, the swing arm 21 and the retaining plate 22 are separate components. Further, the projections 226 on the blades 225 on two lateral sides of the retaining plate 22 can be coupled with corresponding depressions 216, whereby the swing arm 21 and the retaining plate 22 will be combined to offer the function of flexile retaining.

What is claimed is:

1. A rotary wrench display bracket, comprising:

a hanging slab being a slab body with a predetermined thickness, a through hole going through said hanging slab at a predetermined location;

a retaining frame further comprising a swing arm and a retaining plate having a U shape, a top end of said swing arm being provided with a pivotal through hole, a lower end of said swing arm being extended with a support plate, an end of said pivotal through hole being extended with the retaining plate that can be freely opened, at least one lateral side of said retaining plate being provided with a flexible plate pointing inwardly; and a mount being a polygonal body passing through said pivotal hole and said through hole of said hanging slab, said mount being capable of being rotationally secured to said hanging slab; and wherein said through hole is provided with a hanging hole formed right above said through hole and a pair of confining projections disposed below said through hole of said hanging slab.

2. The rotary wrench display bracket of claim 1 wherein a calibration is provided around said through hole.

* * * * *